US006234051B1

(12) United States Patent
Bareggi

(10) Patent No.: US 6,234,051 B1
(45) Date of Patent: May 22, 2001

(54) TIGHTENING TOOL WITH INTERCHANGEABLE INSERTS

(75) Inventor: Luigi Bareggi, Milan (IT)

(73) Assignee: BLM S.A.S. Di L. Bareggi & C., Cusano Milanino (IT)

( * ) Notice: Subject to any disclaimer, the term of this patent is extended or adjusted under 35 U.S.C. 154(b) by 0 days.

(21) Appl. No.: 09/589,265

(22) Filed: Jun. 7, 2000

(30) Foreign Application Priority Data

Jun. 16, 1999 (IT) ..... MI99A1341

(51) Int. Cl.[7] ..... B25B 23/144
(52) U.S. Cl. ..... 81/479; 73/862.21
(58) Field of Search ..... 81/467, 478, 479; 73/862.21, 862.25

(56) References Cited

U.S. PATENT DOCUMENTS 5,172,616 * 12/1992 Negishi ..... 81/467
5,315,501 * 5/1994 Whitehouse ..... 81/467 X

FOREIGN PATENT DOCUMENTS

2829009 * 1/1980 (DE) ..... 81/479

* cited by examiner

*Primary Examiner*—James G. Smith
(74) *Attorney, Agent, or Firm*—Martin Fleit

(57) ABSTRACT

A manual or powered screwing tool comprising a body to which is coupled one of different removable inserts and a sensor for detection of the torque exerted on the mechanical member which sends a data signal directed to calculation means to obtain significant tool action parameters. On each insert is mounted a sender of signals designed to identify the insert in a manner differentiating it from other inserts and with the body is associated a circuit comprising an antenna member designed to receive signals sent by the sender mounted on the insert coupled to the tool with the antenna signal being directed to the calculation means to influence calculation of said parameters.

8 Claims, 3 Drawing Sheets

TIGHTENING TOOL WITH INTERCHANGEABLE INSERTS

BACKGROUND OF THE INVENTION

The present invention relates to tools used for controlled tightening of mechanical members, typically screwed. There are known screwing devices consisting of a body containing the different control or possibly drive members to which are coupled removable inserts designed to engage with the mechanical member on which they are designed to act. By insert is intended here any configuration of a member which can be coupled in a removable manner to the tool to engage in the member with which it is to engage such as a screw head e.g. in the known configuration of a simple sleeve or wrench head.

In this description the term screwing device is used for simplicity of exposition in its broad general sense of device designed to act on a mechanical member to turn it. Accordingly it is intended that among these devices hand operated dynamometric wrenches and powered tools i.e. equipped with electrical or pneumatic generating actuators indicated generally as screwers are to be included. These general screwing devices to which the invention relates are equipped with systems of measurement and control of different parameters related to the operation which they accomplish on the mechanical member engaged by the tool by means of an interchangeable insert. These parameters can be the operation code, the torque, the tightening angle or the like. With the screwing tool are also associated sensing and data treatment and processing systems for presenting data on the parameters to the operator using the manual screwing tool like a torque wrench or even to control the feeding to drive members in powered screwing tools so that they will operated in accordance with the preset parameters.

The operating parameters in accordance with which to act on the member to be tightened which for the sake of brevity is assumed to be a screw are often the univocal function of the size of the engageable part of the member, in this case the screw head. Thus a 13 mm hexagon corresponds to an M8 screw and so forth.

The specific insert coupled with the tool and corresponding to the screw head to be engaged by it has thus a correspondence with the dimension of the threaded screw shank and therefore with the desired screwing parameters. For reasons of speed in screwing parameter setting operations and to avoid errors due to manual setting it has been proposed to collect the inserts which can be mounted on the tool in a magazine or rack where each insert could occupy a single housing corresponding to it. In this manner is created a univocal correspondence between the seat on the magazine (commonly termed 'bush changer') and screwing parameters of the screw on which the insert housable in that seat of the rack is designed to operate.

It is thus possible to equip each magazine seat which collects the inserts with a sensor to detect the taking of the corresponding insert and send insert identification data to the screwing tool to be used for processing the screwing parameters for the screw on which the insert taken is designed to operate.

The system proves to be complicated and the data can be distorted by errors in the coupling between inserts and their seats in addition to requiring the provision of specific univocal couplings between each insert and its bush changer magazine seat, which can even be a limitation on the choice and assortment of the inserts to be used by the user. In addition the entire system of creation of the insert magazine with seats each equipped with a sensor to be wired to the screwing tool control parameter processing circuits is complicated, cumbersome and costly.

The general purpose of the present invention is to provide a screwing tool which can be coupled to a plurality of inserts making up a member for engagement with mechanical members and in which the tool operating parameters can be influenced by the specific insert coupled to the tool which would be reliable, low in cost and not limit the choice and variation of the inserts to be used.

SUMMARY OF THE INVENTION

To achieve these and other purposes which will be clarified in the following description, in accordance with the present invention a manual or powered screwing tool comprising a body to which is coupled one of different removable inserts each of which is designed to engage a corresponding type of mechanical member on which the tool is designed to act and also comprising a sensor for detection of the torque exerted on the mechanical member which sends a data signal directed to calculation means to obtain from the sensor signal significant parameters for the action of the tool on the mechanical member and on each insert is mounted a sender of signals designed to identify the insert in a manner differentiating it from other inserts and with the body is associated a circuit comprising an antenna member designed to receive signals sent by the sender mounted on the insert coupled to the tool with the antenna signal being sent to the calculation means to influence the calculation of said parameters.

BRIEF DESCRIPTION OF THE DRAWINGS

To better clarify the purposes and characteristics of the device in accordance with the present invention an exemplifying embodiment thereof is described below and illustrated in the annexed drawings wherein.

DETAILED DESCRIPTION OF THE INVENTION

Figure 1:
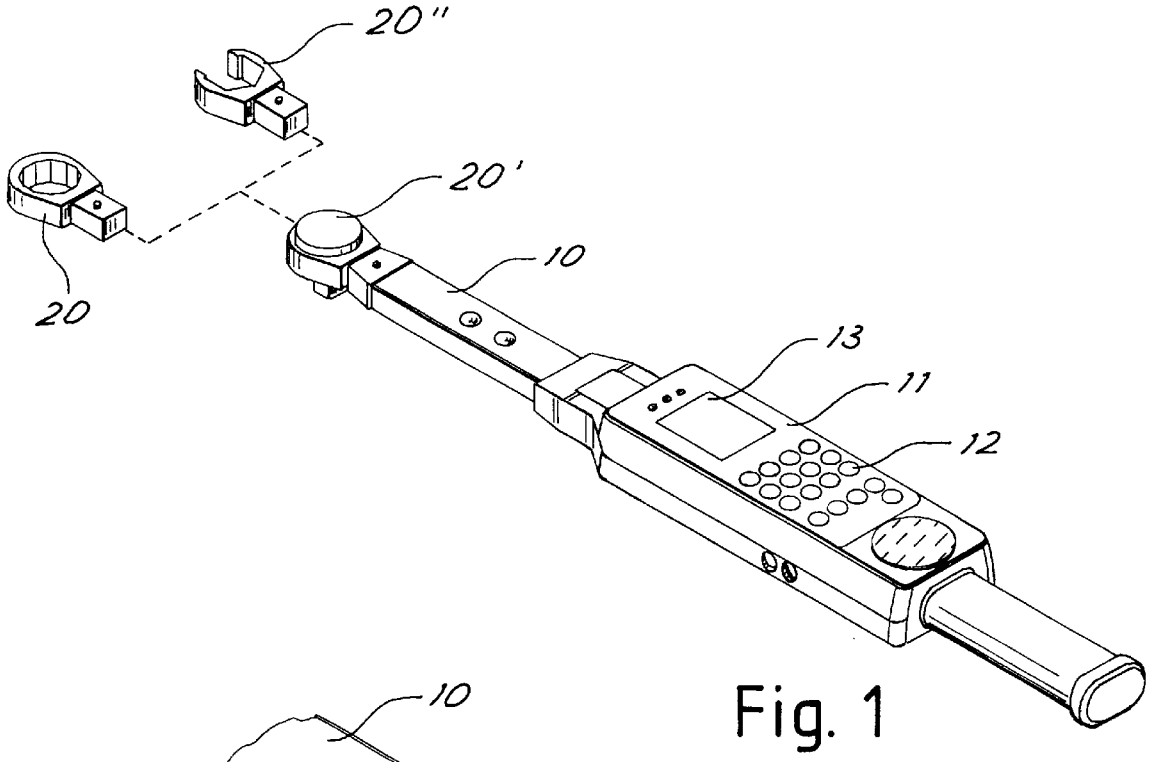
FIG. 1 shows an overall view of a screwing tool in accordance with the present invention.

FIG. 1 shows a manually operated dynamometric wrench for screwing screws or nuts and consisting of a grippable body 10 on which is mounted a housing 11 designed to contain a data processing unit. A keyboard 12 for typing in allows entry of data on the basis of which are to be calculated the screwing parameters while a display 13 allows viewing of the data to allow the operator to take action to perform screwing while observing the calculated parameters.

A dynamometric wrench of this type is described e.g. in Italian patent application MI99A000111 of Jan. 22, 1999 filed by the same applicant.

It is intended that where data processing requires a unit which cannot be conveniently contained in the housing 11 due to the complexity of the required processing and for recording of the screwing operations performed or for connection of the tool to an external power supply or to a more complex control system the body 11 can be connected by wiring to an external processing unit.

To the arm 10 can be connected removably and alternatively connectable inserts 20, 20' and 20" of which the insert 20' is shown mounted and the other two replaceable are shown in exploded view.

Figure 2:
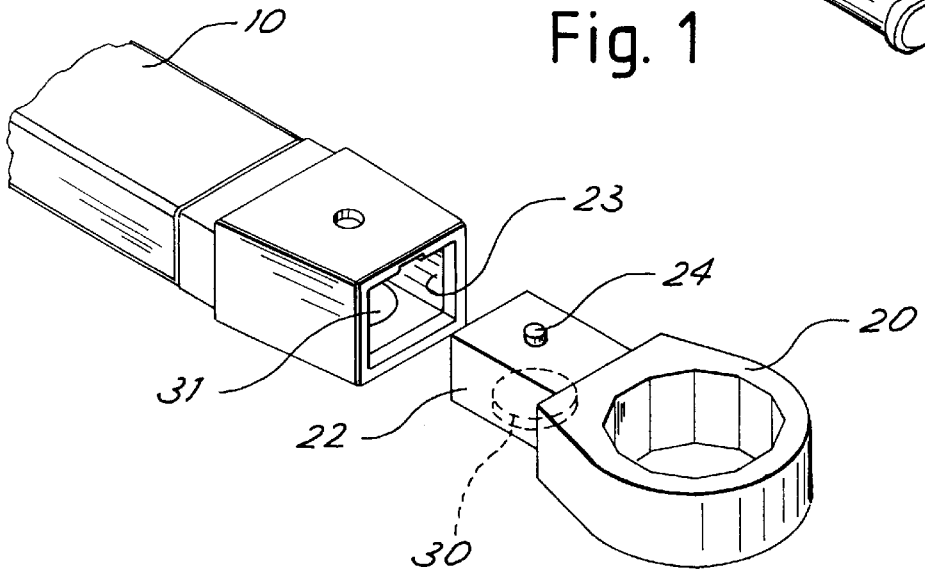
FIG. 2 shows a partial perspective view of a detail of the screwer of FIG. 1.
Figure 5:
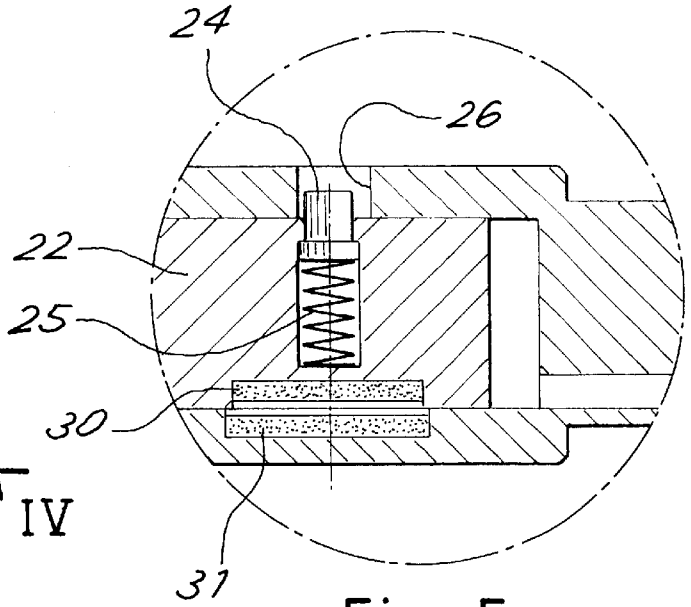
FIG. 5 shows an enlarged detail of FIG. 4.
Figure 4:
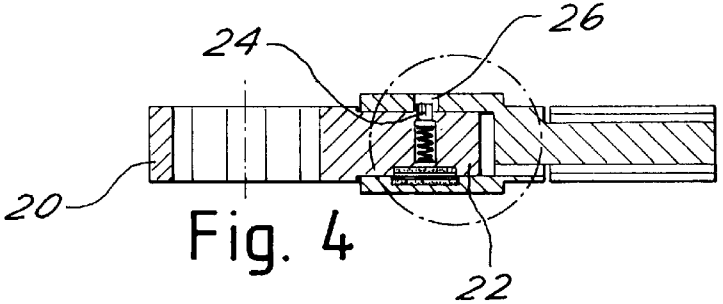
FIG. 4 shows a cross section view along plane of cut IV—IV of FIG. 3.
Figure 3:
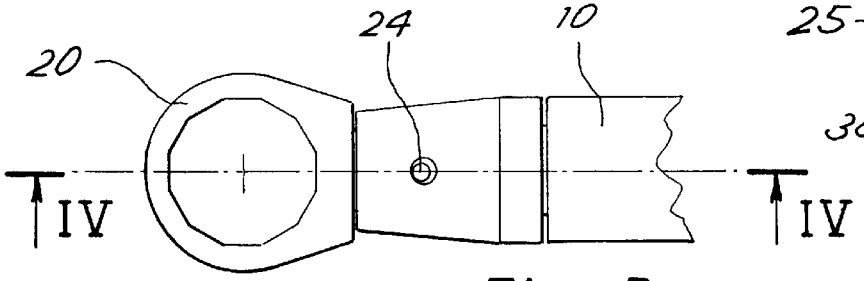
FIG. 3 shows a plan view of the tool of FIG. 2.

As shown better in FIGS. 2, 4 and 5 the insert 20 has a tang 22 which can be received by a corresponding seat 23 on the end of the arm 10. Advantageously there are provided means for avoiding accidental detachment of the insert during use as exemplified by a pin 24 thrust elastically outward by a spring 25 to insert its end in a hole 26 when the insert is applied to the tool.

In accordance with the present invention the tang 22 is inserted in a member 30 located facing a member 31 mounted on the wall of the seat 23 when the insert is coupled to the tool.

The position of the members 30 and 31 is in no way critical there being required only a sufficiently small distance between them when the insert is mounted on the screwing tool for the purposes set forth below.

The members 30 and 31 are respectively a transponder and its antenna operating in accordance with the widely known prior art. The member 30 consists of a miniaturized transponder of the type indicated in trade by 'tag'. This is a device available in trade for reading only or for reading and writing and normally but not necessarily operating at radio-frequency. It will be the type normally in quiescent state activated by the inductive field produced by the sending-receiving antenna for interrogation which is diagrammed with the member 31. The tag can be the read only or advantageously the programmable type.

In the memory normally provided in the tag there can be written characters or a string of characters which identify it and with which can be associated in an amply detailed manner the characteristics of the mechanical member to be screwed by means of the insert and which depend on the configuration of the insert and hence supply to the screwing tool processing unit adequate data for determination of all the necessary parameters with which the screwer operation to be performed with that insert must comply.

Figure 6:
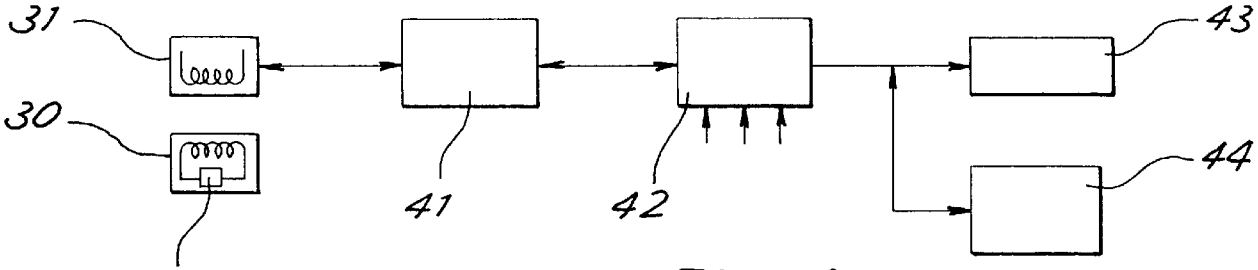
FIG. 6 shows a partial circuit diagram of the tool of FIG. 1.

As shown diagrammatically in FIG. 6 the signal sent by the antenna 31 excites the transponder circuit 30 which in turn sends a recognition signal containing data (code) extracted from the memory 40, a function of the screwer operation parameters determined by the nature and configuration of the insert with which the transponder is associated and hence of the member to be tightened.

The signals received from the antenna 31 are decoded in 41 and processed in the microswitch 42 in combination with other signals addressed to the microprocessor from additional sensor and control members or suited to the manual input of data with which the tool is equipped. The microprocessor 42 transmits the processed signals corresponding to the required screwing parameters to a display 43 and/or a tool control unit 44.

The use of an identification system preferably but not necessarily radio-frequency (RFID) identified above proposed by the present invention allows achievement of specific and very interesting results in the specific application. By the simple coupling of the insert and the manual or powered screwer tool the operator achieves sending of a code paired with a number of data which can be quite high and which would require a laborious keyboard entry with resulting risk of errors. It is also allowed to memorize and control the use of a single tool in time, which is cost effective on mass production lines where these screwing tools are typically used.

In addition the size of a transponder and coupled antenna using present-day technology make them easy to position in the mechanical coupling between the insert, which can have the appropriate configuration required by the designer for good mechanical connection or adaptation to production standards.

The antenna-transponder coupling can be of any basically electromagnetic type and variable depending on the production technology of the transponder or similar equivalent device and hence broadly insensitive to fouling or the accumulation of external particles which cannot be excluded in the type of tool to which the present invention relates considering the environment where they operate.

Figure 7:
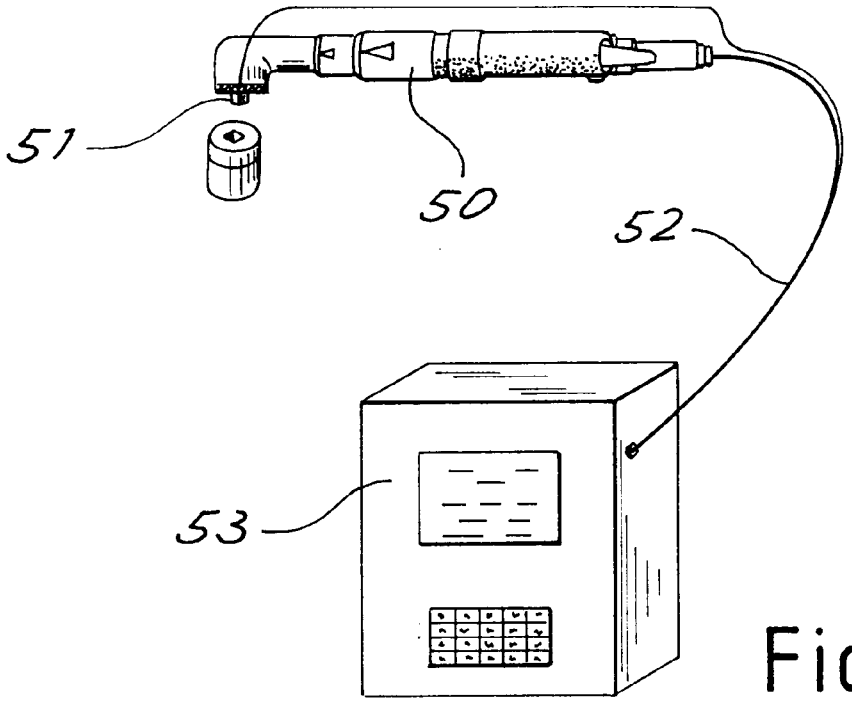
FIG. 7 shows an overall view of a different embodiment of the screwer in accordance with the present invention.
Figure 8:
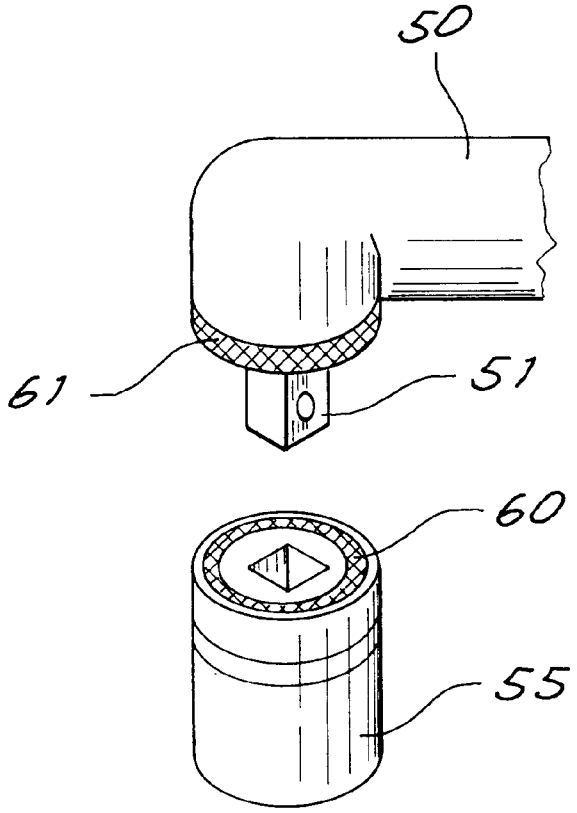
FIG. 8 shows a partial perspective view of a detail of the screwer of FIG. 7.

FIGS. 7 and 8 show an application of the present invention to a powered screwer.

The screwer comprises a body 50 containing in the conventional manner a motor which with a suitable transmission controls rotation of an engagement member 51. The motor shown is powered through a control cable 52 leading to a control unit 53.

Over the same cable are transmitted to the control unit signals related to the applied torque of the motor not shown to the coupling 51 and sent by sensors which are conventionally provided in screwers of known type to which the present invention relates as well as possible other signals sent by sensors of other coupling movement parameters.

In response to the data contained in the signals sent by the sensors mounted on the screwer the control unit 53 modulates the power to the screwer motor so that to the engagement member 51 will be applied rotation torque and movement corresponding to predetermined parameters.

An insert shown in sleeve form 55 for engagement with the head of a mechanical member to be tightened is designed to be coupled on the coupling 51.

In the area surrounding the coupling 51 is arranged an antenna member 61 corresponding operationally to the antenna member 31 described with reference to the manual tool shown in FIGS. 1 to 6. On the sleeve is mounted a transponder 60 in a position facing the antenna 61 when the sleeve shown in exploded view in FIG. 8 is fitted on the coupling 51. The transponder 60 is the same type and has the same function as the transponder 30 described in relation to the manual tool illustrated in FIGS. 1 to 6 and is not further described. The signal emitted by the transponder 60 is sent to the calculation means contained in the control unit while the data identifying the sleeve insert 55 and contained in this signal affect the calculation means in the calculation of the tightening parameters on the basis of which the power fed to the screwer motor is modulated.

The tightening parameters and other supplementary data useful for identification of the sleeve insert mounted on the screwer can be displayed by the control unit 53 just as data useful to the operator for performance of the tightening operation by means of the screwer can be displayed.

What is claimed is:

1. Manual or powered screwing tool comprising a body to which is coupled one of different removable inserts each of which is designed to engage a corresponding type of mechanical member on which the tool is designed to act and also comprising a sensor for detection of the torque exerted on the mechanical member which sends a data signal directed to calculation means to obtain from the sensor signal significant parameters for the action of the tool on the mechanical member characterized in that on each insert is mounted a sender of signals designed to identify the insert in a manner differentiating it from other inserts and with the body is associated a circuit comprising an antenna member designed to receive signals sent by the sender mounted on the insert coupled to the tool with the antenna signal being directed to the calculation means to influence calculation of said parameters.

2. Tool in accordance with claim 1 wherein the antenna sends signals designed to activate the sender of the insert coupled with the tool to cause sending of the signals by the sender.

3. Tool in accordance with claim 2 wherein the sender mounted on the insert is the transponder type.

4. Tool in accordance with claim 1 wherein the insert is coupled to the tool by insertion of a tanged member in a seat with the sender and the antenna being mounted opposite walls respectively of the tool and the insert which are facing when the insert is coupled to the tool.

5. Tool in accordance with claim 1 wherein the insert is coupled to the tool by insertion of a tanged member in a seat with the sender and the antenna being mounted opposite walls respectively of the tang and the seat which are facing when the insert is coupled with the tool.

6. Tool in accordance with claim 3 wherein the transponder comprises a memory programmable to memorize data for identification of the insert on which it is mounted.

7. Tool in accordance with claim 1 wherein it is controlled manually and the significant parameters of the tool action on the mechanical member produced by calculation means are shown on a display.

8. Tool in accordance with claim 1 wherein it is powered by means of an actuator and the significant parameters of the tool action on the mechanical member are sent to a means which control the power fed to said actuator depending on the value of said parameters.

* * * * *